US007791019B2

(12) United States Patent
Beauchamp et al.

(10) Patent No.: US 7,791,019 B2
(45) Date of Patent: Sep. 7, 2010

(54) AMBIENT PRESSURE PYROELECTRIC ION SOURCE FOR MASS SPECTROMETRY

(75) Inventors: Jesse L. Beauchamp, La Canada Flintridge, CA (US); Evan L. Neidholdt, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 418 days.

(21) Appl. No.: 11/972,754

(22) Filed: Jan. 11, 2008

(65) Prior Publication Data

US 2008/0179514 A1 Jul. 31, 2008

Related U.S. Application Data

(60) Provisional application No. 60/880,185, filed on Jan. 11, 2007.

(51) Int. Cl.
*H01J 49/00* (2006.01)

(52) U.S. Cl. ..... 250/288; 250/281; 250/282; 250/423 R; 250/424; 250/425; 315/111.01; 315/111.81; 315/111.91

(58) Field of Classification Search ..... 250/423 R, 250/424, 425, 281, 282, 288; 315/111.01, 315/111.81, 111.91
See application file for complete search history.

(56) References Cited

U.S. PATENT DOCUMENTS

2006/0076505 A1* 4/2006 Fischer et al. ..... 250/423 P

OTHER PUBLICATIONS

Sato et al., Chemistry Letters, "The Chemical Society of Japan", 2005, 1178-1179, 34.

* cited by examiner

*Primary Examiner*—Jack I Berman
*Assistant Examiner*—Hanway Chang
(74) *Attorney, Agent, or Firm*—Milstein Zhang & Wu LLC; Joseph B. Milstein

(57) ABSTRACT

A compact, low power ambient pressure pyroelectric ionization source. The source can be constructed using a z-cut lithium niobate or lithium tantalate crystal with an attached resistive heater mounted in front of the atmospheric pressure inlet of an ion trap mass spectrometer. Positive and negative ion formation alternately results from thermally cycling the crystal over a narrow temperature range. Ionization of molecules such as 1,1,1,3,3,3-hexafluoroisopropanol or benzoic acid results in the observation of the singly deprotonated species and their clusters in the negative ion mass spectrum. Ionization of molecules such as triethylamine or triphenylamine with the source results in observation of the corresponding singly protonated species of each in the positive ion mass spectrum. The pyroelectric crystals are thermally cycled by as little as 30 K from ambient temperature. Ion formation is largely unaffected by contamination of the crystal faces. This ion source is robust.

20 Claims, 12 Drawing Sheets

APPIS DETECTS CBW AGENT SIMULANTS

APPIS MASS SPECTRUM
(INDICATED SPECIES ARE PROTONATED)

DIETHYL PHOSPHORAMIDATE
(DEPA): SIMULATES TABUN

2-BUTYLAMINOETHANETHIOL
(BAEL): SIMULATES VX

DIMER

AMBIENT PRESSURE PYROELECTRIC ION SOURCE FOR MASS SPECTROMETRY

CROSS-REFERENCE TO RELATED APPLICATIONS

This application claims priority to and the benefit of U.S. provisional patent application Ser. No. 60/880,185, filed Jan. 11, 2007, which application is incorporated herein by reference in its entirety.

STATEMENT REGARDING FEDERALLY FUNDED RESEARCH OR DEVELOPMENT

The U.S. Government has certain rights in this invention pursuant to Grant No. CHE0416381 awarded by the National Science Foundation.

FIELD OF THE INVENTION

The invention relates to ion sources in general and particularly to an ion source for mass spectrometry that employs a pyroelectric material as a medium for causing materials of interest to be ionized.

BACKGROUND OF THE INVENTION

The pyroelectric effect is observed when a pyroelectric material is subjected to a change in temperature. By way of example, a thin, parallel-sided sample of material, such as a tourmaline crystal can be cut so that its crystallographic symmetry axis is perpendicular to the flat surfaces. The unit cells of pyroelectric materials so cut have a net dipole moment oriented along the direction normal to the flat surfaces (or along the crystallographic symmetry axis). The dipole moment per unit volume of the material is called the spontaneous polarization $P_S$. $P_S$ is always nonzero in a pyroelectric material. $P_S$ exists in the absence of an applied electric field and can be thought of as a layer of bound charge on each flat surface of the sample, one face having a net positive charge and the other a net negative charge.

Present applications of the pyroelectric effect include infrared detectors, the production and manipulation of focused and unfocused electron and ion beams under vacuum conditions, x-ray generation and x-ray fluorescence measurements, and possibly the induction of nuclear reactions. Aside from a report by Sato et al., *Chem. Lett.* 2005, 34, 1178-1179, of laser desorption of ions from lead lanthanum zirconate titanate (PLZT), to the best knowledge of the inventors, pyroelectric materials have not previously been employed as a source of ions for chemical analysis using mass spectrometry.

There is a need for a compact, robust, ambient pressure ion source that can be used in mass spectrometry.

SUMMARY OF THE INVENTION

In one aspect, the invention relates to an ion source for mass spectrometry configured to be operable at ambient pressure. The ion source comprises a pyroelectric substance having a first face and a second face, at least the first face disposed substantially normal to a polarization axis of the substance, a selected one of a heater and a cooler disposed adjacent the second face of the pyroelectric substance, a power supply in communication with the selected one of a heater and a cooler, the power supply configured to provide energy sufficient to change a temperature of the first face of the pyroelectric substance at a rate of the order of 10° C. per minute, a vapor entry port for a sample of interest, the vapor entry port configured to operate at ambient pressure, the vapor entry port configured to allow the entering vapor to interact with the first face of the pyroelectric substance, and an exit port configured to provide a stream of ionized species at ambient pressure. The ion source is configured to produce a stream of ionized species at ambient pressure in response to a change in temperature of the first face of the pyroelectric substance.

In one embodiment, the entering vapor interacts electrically with the first face of the pyroelectric substance. In one embodiment, the ion source further comprises a vapor containment shroud.

In one embodiment, the pyroelectric substance comprises a polar crystal. In one embodiment, the polar crystal is a selected one of lithium niobate, lithium tantalate, lead lanthanum zirconate titanate, barium titanate, and tourmaline. In one embodiment, the first face and the second face of the pyroelectric substance are each disposed substantially normal to a polarization axis of the substance. In one embodiment, the selected one of a heater and a cooler is a selected one of a resistance heater and a Peltier device. In one embodiment, the power supply is an electrical power supply. In one embodiment, the exit port is an atmospheric inlet of a mass spectrometer. In one embodiment, the ion source further comprises a temperature measuring device adjacent the pyroelectric substance. In one embodiment, the ion source further comprises a measurement and control circuit configured to control a selected one of a temperature change magnitude and a temperature change range. In one embodiment, the first face and the second face of the pyroelectric substance are disposed substantially normal to a polarization axis of the pyroelectric substance, and are spaced apart at any distance from one another.

In one embodiment, the invention provides a mass spectrometer that comprises an atmospheric pressure inlet in fluid communication with the ion source configured to be operable at ambient pressure described hereinabove.

In another aspect, the invention features a method of generating a stream of ions at ambient pressure. The method comprises the steps of providing a pyroelectric substance having a first face and a second face, at least the first face disposed substantially normal to a polarization axis of the substance, providing a selected one of a heater and a cooler disposed adjacent the second face of the pyroelectric substance, providing a power supply in communication with the selected one of a heater and a cooler, the power supply configured to provide energy sufficient to change a temperature of the first face of the pyroelectric substance at a rate of the order of 10° C. per minute, providing a vapor of a sample of interest, the vapor interacting with the first face of the pyroelectric substance, providing an exit port configured to allow the exit of a stream of ionized species at ambient pressure, and changing a temperature of the first face of the pyroelectric substance during a time interval when the vapor of the sample of interest is proximal to the first face of the pyroelectric substance so as to produce ions of the sample of interest. Upon operation of the method, a stream of ions at ambient pressure is provided at the exit port.

In one embodiment, the method further comprises the step of controlling a selected one of a temperature change magnitude and a temperature change rate of the first face of the pyroelectric substance.

In one embodiment, the stream of ions at ambient pressure comprises a stream of positive ions. In one embodiment, the stream of ions at ambient pressure comprises a stream of negative ions. In one embodiment, the stream of ions at ambient pressure comprises chemical nerve agent ions. In one embodiment, the chemical nerve agent ions include ions derived from the V nerve agent class. In one embodiment, the chemical nerve agent ions include ions derived from Tabun.

The foregoing and other objects, aspects, features, and advantages of the invention will become more apparent from the following description and from the claims.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

FIG. 6(*b*) is a diagram showing the temporal variation of total ion yield from hexafluoroisopropanol as the pyroelectric crystal is cooled.

FIG. 6(*c*) is a diagram showing a negative ion mass spectrum of sublimed benzoic acid, in which the deprotonated acid is observed.

FIG. 6(*d*) is a diagram showing the temporal variation of total ion yield from benzoic acid as the crystal is cooled.

FIG. 7(*b*) is a diagram showing the temporal variation of ion yield from triethylamine as the crystal is heated.

FIG. 7(*c*) is a diagram showing a positive ion mass spectrum of sublimed triphenylamine, in which the protonated amine is observed.

FIG. 7(*d*) is a diagram showing the temporal variation of ion yield from triphenylamine as the crystal is heated.

DETAILED DESCRIPTION OF THE INVENTION

The present invention provides a novel, compact ambient pressure pyroelectric ion source (APPIS) for mass spectrometry that comprises a pyroelectric material and associated thermal control elements.

While the invention contemplates using any convenient pyroelectric material or substance, the present description will give examples using the materials lithium niobate ($LiNbO_3$) and lithium tantalate ($LiTaO_3$). The pyroelectric properties of lithium niobate and lithium tantalate make them very useful in certain applications. Since pyroelectric crystals are non-centrosymmetric and possess at most one axis of rotation as a crystallographic symmetry element, a non-zero dipole for each unit cell imparts a net polarization to the bulk crystal. The pyroelectric effect, which is the polarization change of the crystal due to temperature change, leads to an imbalance of charge in the crystal. In a cut crystal the two faces orthogonal to the z crystallographic axis become oppositely charged. This results in a net electrical potential on each z face of the crystal unless it is compensated in some manner.

In the embodiments described, the source utilizes z cut $LiNbO_3$ and $LiTaO_3$ crystals of various dimensions which were purchased from Elan Ltd., St. Petersburg, Russia. The crystals were used as received from Elan, and did not have an electrode attached to any crystal face. Chemical samples were purchased from Aldrich or Fluka, both subsidiaries of Sigma-Aldrich, 3050 Spruce Street, St. Louis, Mo. 63103 and were used without further purification.

Figure 1:
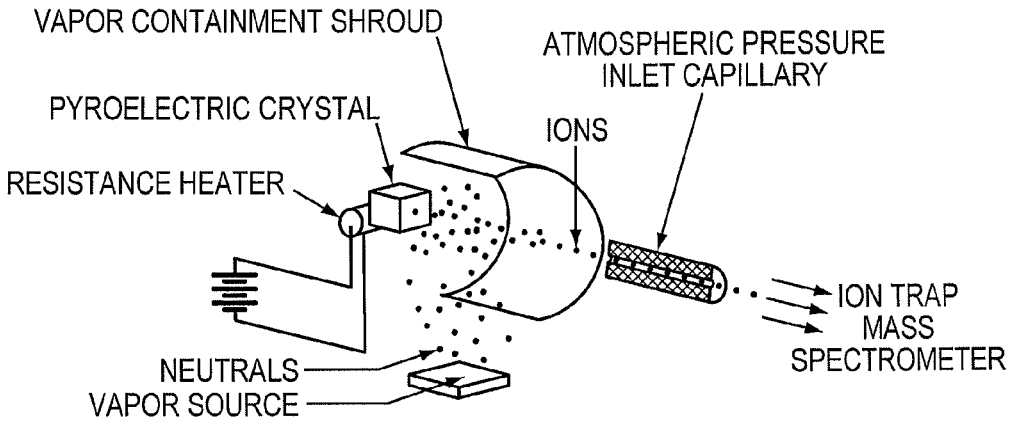
FIG. 1 is a schematic diagram of an illustrative pyroelectric ion source, according to principles of the invention.

FIG. 1 is a schematic diagram of an illustrative pyroelectric ion source. For the embodiments and procedures described here, a 5×5×5 mm pyroelectric $LiTaO_3$ crystal is mounted with the −z face exposed and a resistance heater attached to the +z face. Ions are produced at the −z face of the pyroelectric crystal and travel through the vapor containment shroud to the atmospheric pressure inlet capillary of the mass spectrometer. The heater comprises a 62 ohm, 0.5 watt resistor which was epoxied to the crystal with Arctic Alumina Thermal Adhesive (Arctic Silver Inc, Visalia, Calif.). Temperature is measured with a copper constantan thermocouple by a National Instruments CompactDAQ thermocouple module, interfaced with LabVIEW™, available from National Instruments Corporation of 11500 North Mopac Expressway, Austin, Tex. 78759-3504. LabVIEW™ runs on conventional general purpose programmable computers operating under one or more variants of the Windows, Mac OS, and Linux operating systems.

The power usage of the ion source can be analyzed. We take $q=(Cp)\rho(\Delta T)$ and $P=q/T$ where Cp for $LiTaO_3$=0.06 cal $g^{-1}$ ° $C.^{-1}$ and $\rho$=7.45 g $cm^3$. Using these values, one calculates that 7.0 J are required to raise the temperature of a 5×5×5 mm $LiTaO_3$ crystal 30 K. On the timescale of the experiment, typically 30 seconds, this corresponds to 230 mW, assuming 100% heat transfer efficiency, and no heat loss. This result indicates that in the current implementation the heat transfer and usage efficiency is approximately 30%. It is expected that better heat transfer could be achieved through use of a thermoelectric device with proper thermal bonding. It is expected that designs that improve the thermal efficiency might be developed in the future, but the device as constructed and tested is known to work appropriately, as is further described and shown hereinafter.

In principle, any convenient thickness of a pyroelectric substance can be used, or equivalently, the +z face and the −z face can be separated by any convenient distance. However, it should be recognized that a thicker example of pyroelectric material might require a more powerful heater or cooler in order to raise or lower the temperature of the −z face at the rates needed to produce a suitable pyroelectric behavior, because a larger mass of material will have a larger thermal inertia than will a smaller mass of the same material.

Figure 2:
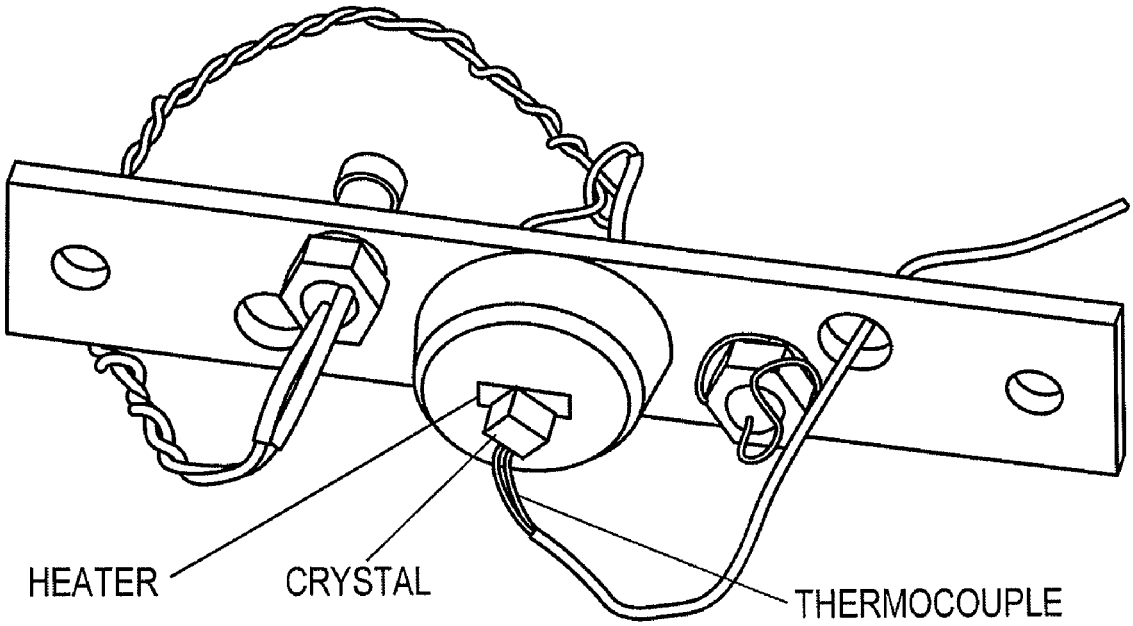
FIG. 2 is an image of one embodiment of a pyroelectric crystal, a heater and a thermocouple shown assembled as components of the pyroelectric ion source, according to principles of the invention.

FIG. 2 is an image of one embodiment of a pyroelectric crystal, a heater and a thermocouple shown assembled as components of the pyroelectric ion source. It is believed that one can use other types of apparatus and other sources of power to heat or cool the pyroelectric material, including for example a Peltier device. In principle, any apparatus or method that can controllably change the temperature of the pyroelectric substance might be employed for that purpose in different embodiments of the invention.

Figure 3:
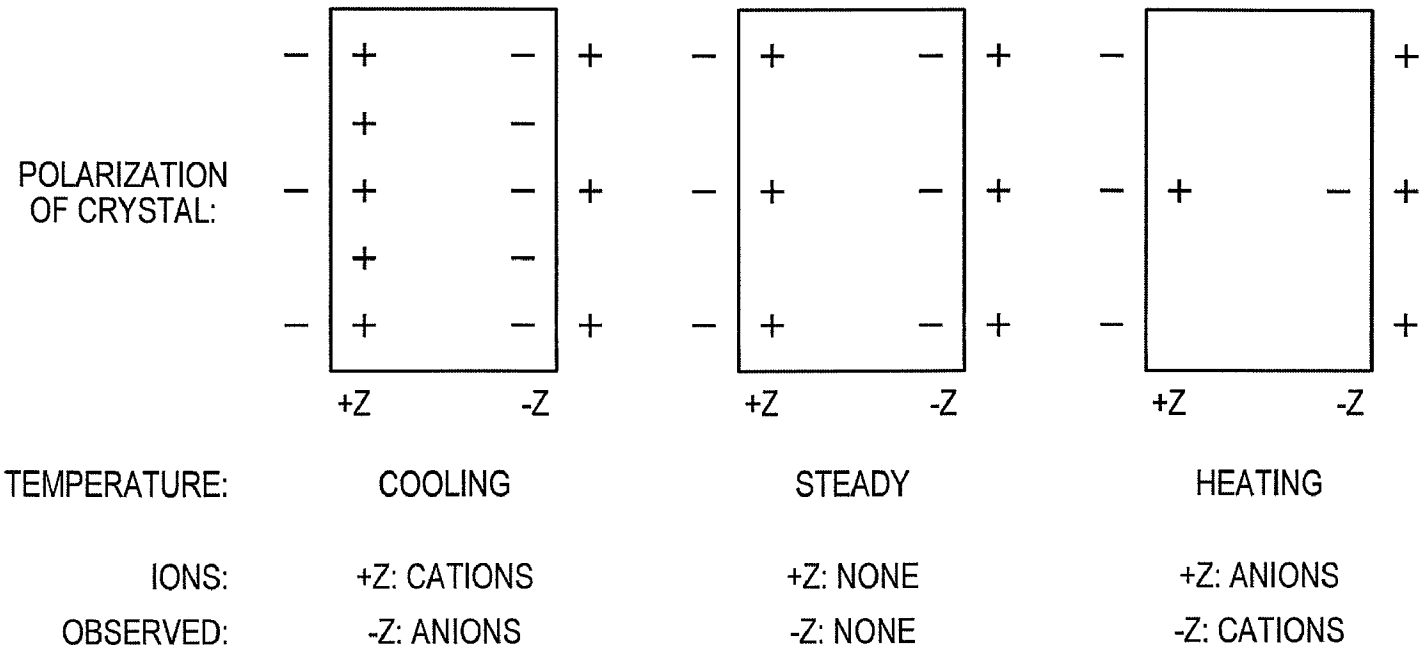
FIG. 3 is a diagram illustrating the relationship between the thermal condition of a pyroelectric crystal and the charge conditions appearing at opposite crystal faces.

Both cations and anions can be produced from a single face of the crystal, but not detected at the same time. FIG. 3 illustrates the physical processes that occur on the +z and −z surfaces of a pyroelectric crystal as the temperature is varied. At a fixed temperature the net charge of the crystal face due to polarization is compensated by charged species of the opposite sign that accumulate at the interface. A decrease in temperature leads to an increase in polarization and net deficits of compensating positive charge on the −z face and compensating negative charge on the +z face. As the crystal is heated, the decrease in polarization results in net surpluses of compensating positive charge on the −z face and compensating negative charge on the +z face. Hence, for a crystal whose −z face is exposed, cations will be detected upon heating. While the crystal is cooling, anions will be detected. The source could have just as easily been constructed with the +z face of the crystal exposed.

Figure 4:
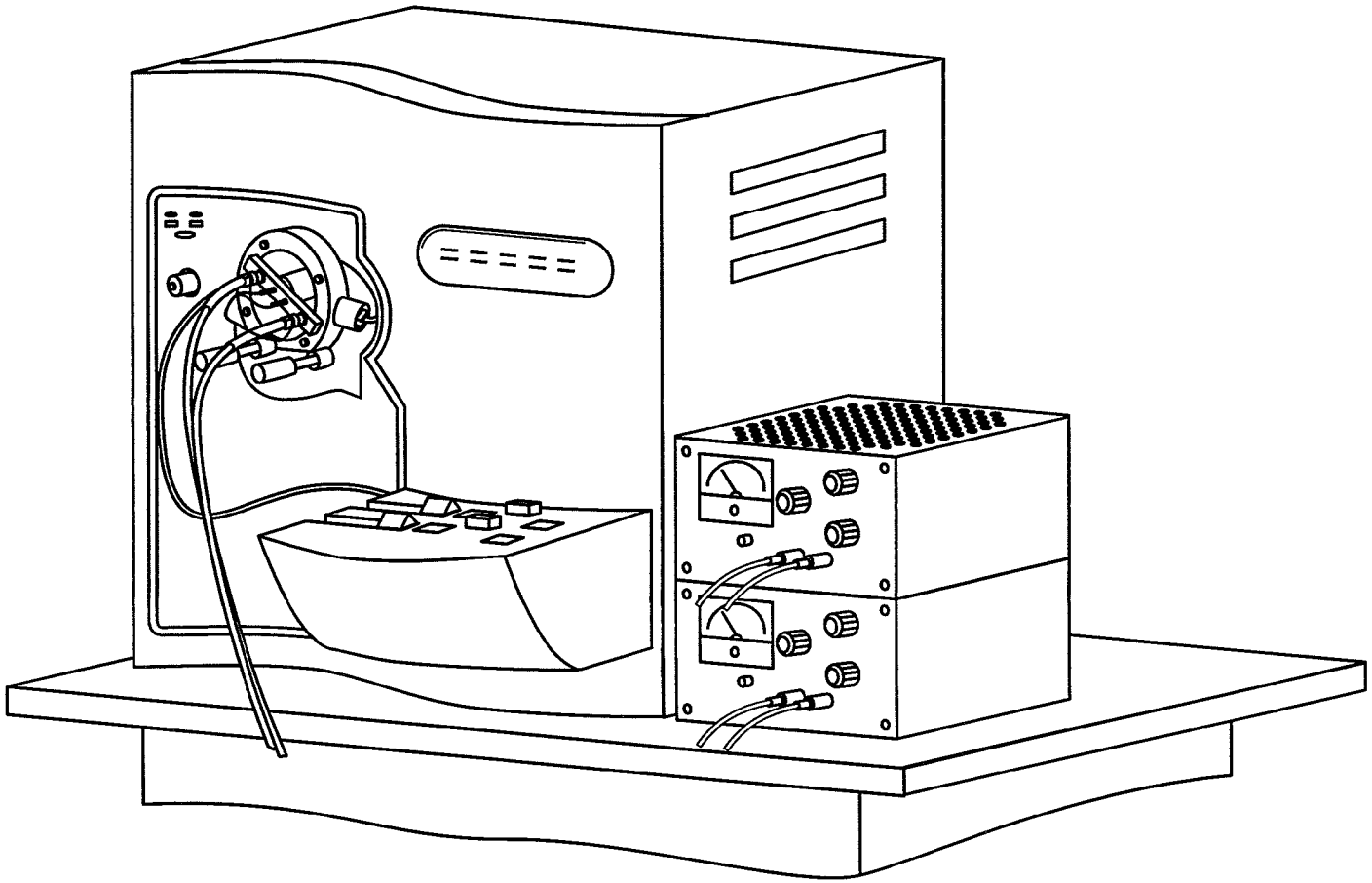
FIG. 4 is an image that shows an ambient pressure pyroelectric ion source mounted on a ThermoFinnigan LCQ Deca XP ion trap mass spectrometer.
Figure 5:
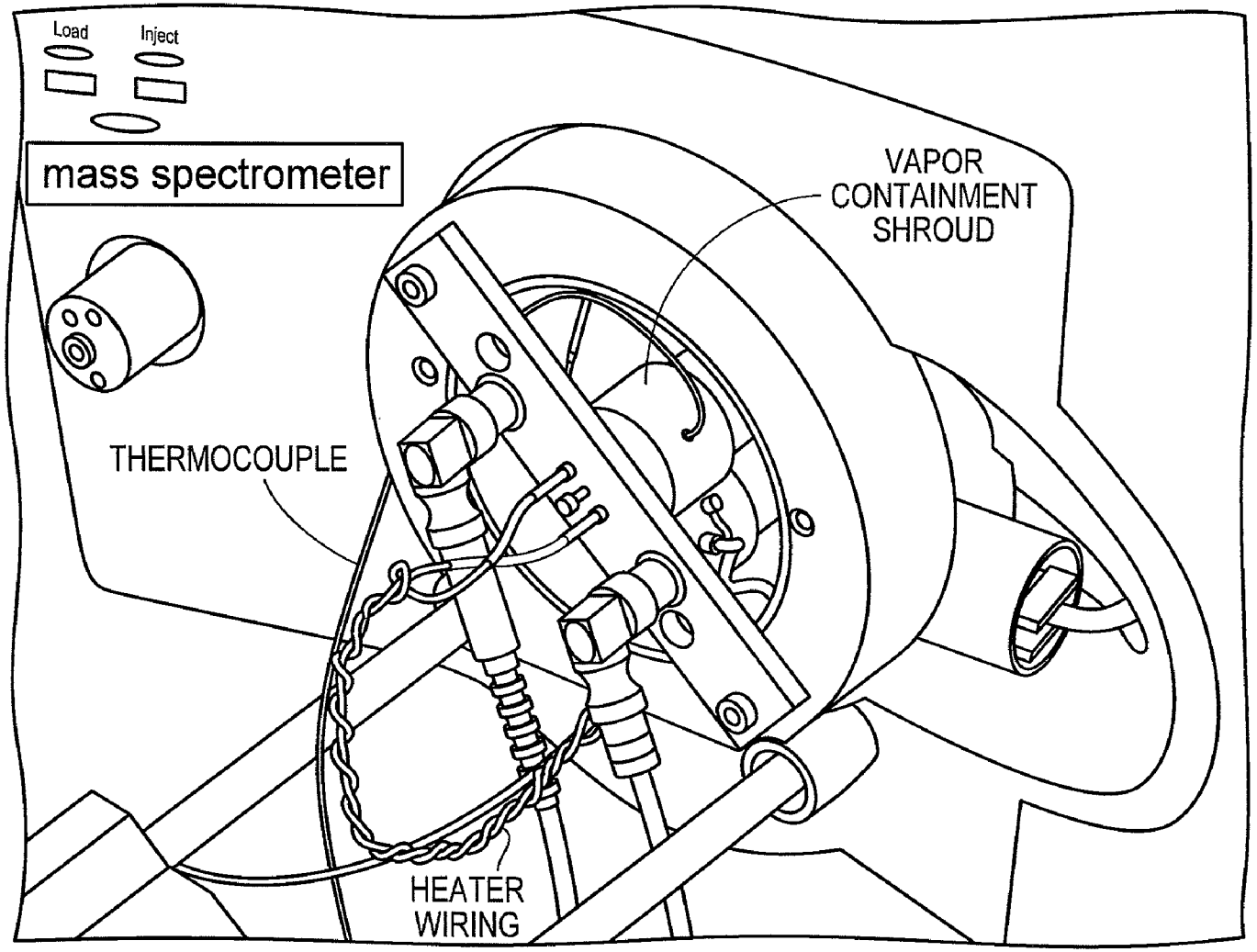
FIG. 5 is an image that shows the mounted ambient pressure pyroelectric ion source in greater detail.

The source is operated at atmospheric or ambient pressure, and employs a shroud made of aluminum to contain sample vapor in the region near the crystal. Other materials could be used to construct the shroud. Sample vapor is introduced into the source through a hole in the containment shroud. The source is mounted in place of the standard electrospray source on a Thermo Finnigan LCQ Deca XP quadrupole ion trap mass spectrometer, in front of the atmospheric pressure inlet capillary, as shown in FIG. 4 and FIG. 5. Except for the ion source replacement, the mass spectrometer was not otherwise modified. FIG. 4 is an image that shows an ambient pressure pyroelectric ion source mounted on a ThermoFinnigan LCQ Deca XP ion trap mass spectrometer. FIG. 5 is an image that shows the mounted ambient pressure pyroelectric ion source in greater detail.

The face of the crystal was positioned at a distance of 7 mm from the capillary inlet. This was determined experimentally to be the optimum distance for maximum signal intensity in the embodiment that was constructed. The sample holder was fitted with a heater so that solid samples could be sublimed into the source as a vapor. Other materials can conveniently be introduced as vapors carried by carrier gas at ambient (or close to ambient) pressures. During all experiments that we performed using the apparatus and procedures described here, the atmospheric pressure inlet capillary was held at ground potential, and its temperature was 270° C. To heat the crystal and sample holder, a pair of Harrison/HP Model 855C DC power supplies passed current through the corresponding heating resistors. The supplies are remotely programmed using LabVIEW™, facilitating recording of the temporal variation of ion yield as the temperature was cycled.

Figure 6:
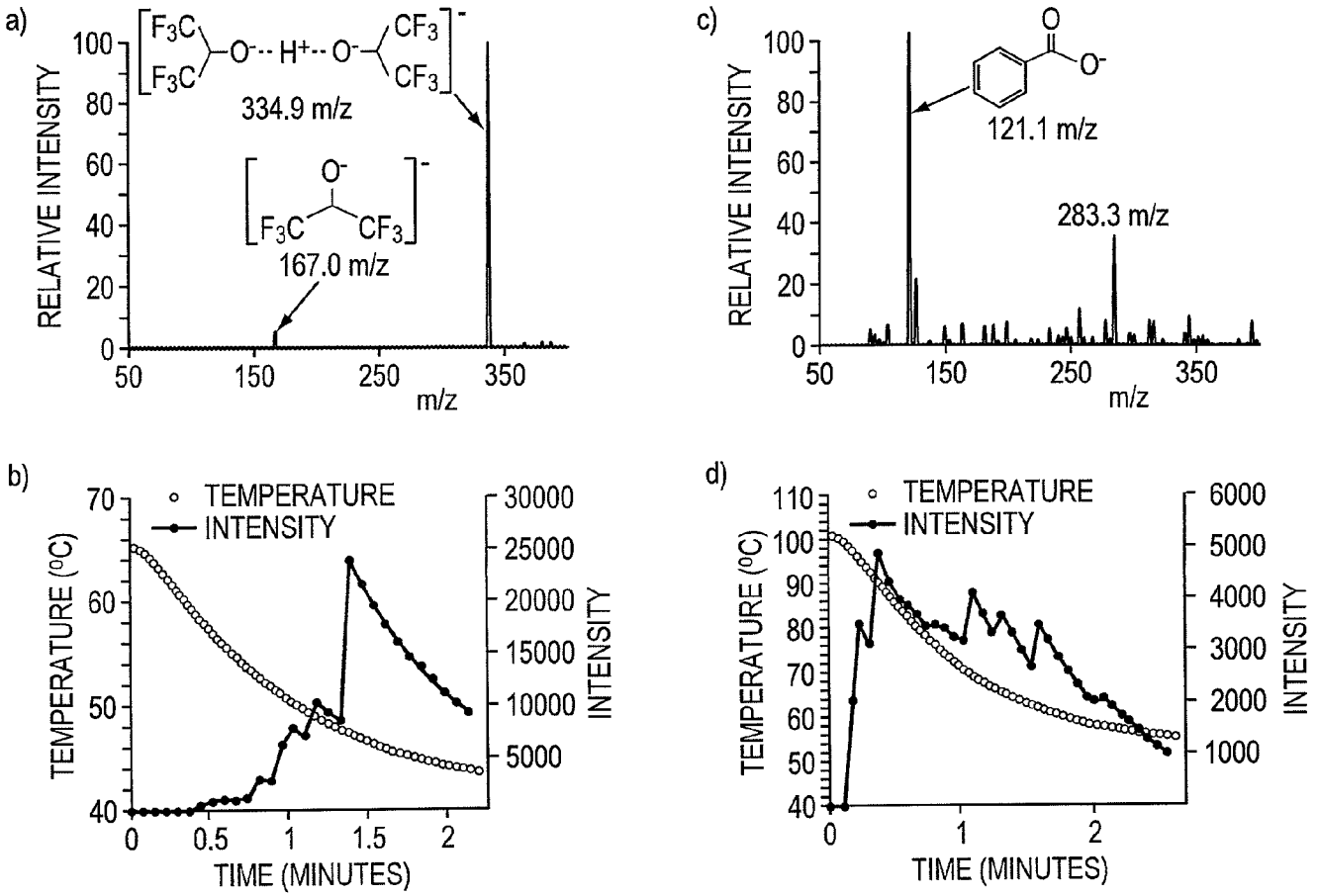
FIG. 6(*a*) is a diagram showing a negative ion mass spectrum of 1,1,1,3,3,3-hexafluoroisopropanol.

FIG. 6(*a*) and FIG. 6(*b*) are the negative ion mass spectrum of 1,1,1,3,3,3-hexafluoro-2-propanol and the temporal variation of ion abundance (total ion current) as the crystal temperature decreases, respectively. Abundant ions in the mass spectrum include the deprotonated alcohol, at 167.0 m/z, and the proton bound dimer of the deprotonated alcohol, at 334.9 m/z. The abrupt changes in ion yield are thought to result from the occurrence of sporadic discharges as the crystal temperature is varied. FIG. 6(*c*) and FIG. 6(*d*) show similar data for the negative ion mass spectrum of benzoic acid. The deprotonated acid appears in the mass spectrum at 121.1 m/z. The peak at 283.3 m/z has not been identified. Sporadic ion production is again observed.

Figure 7:
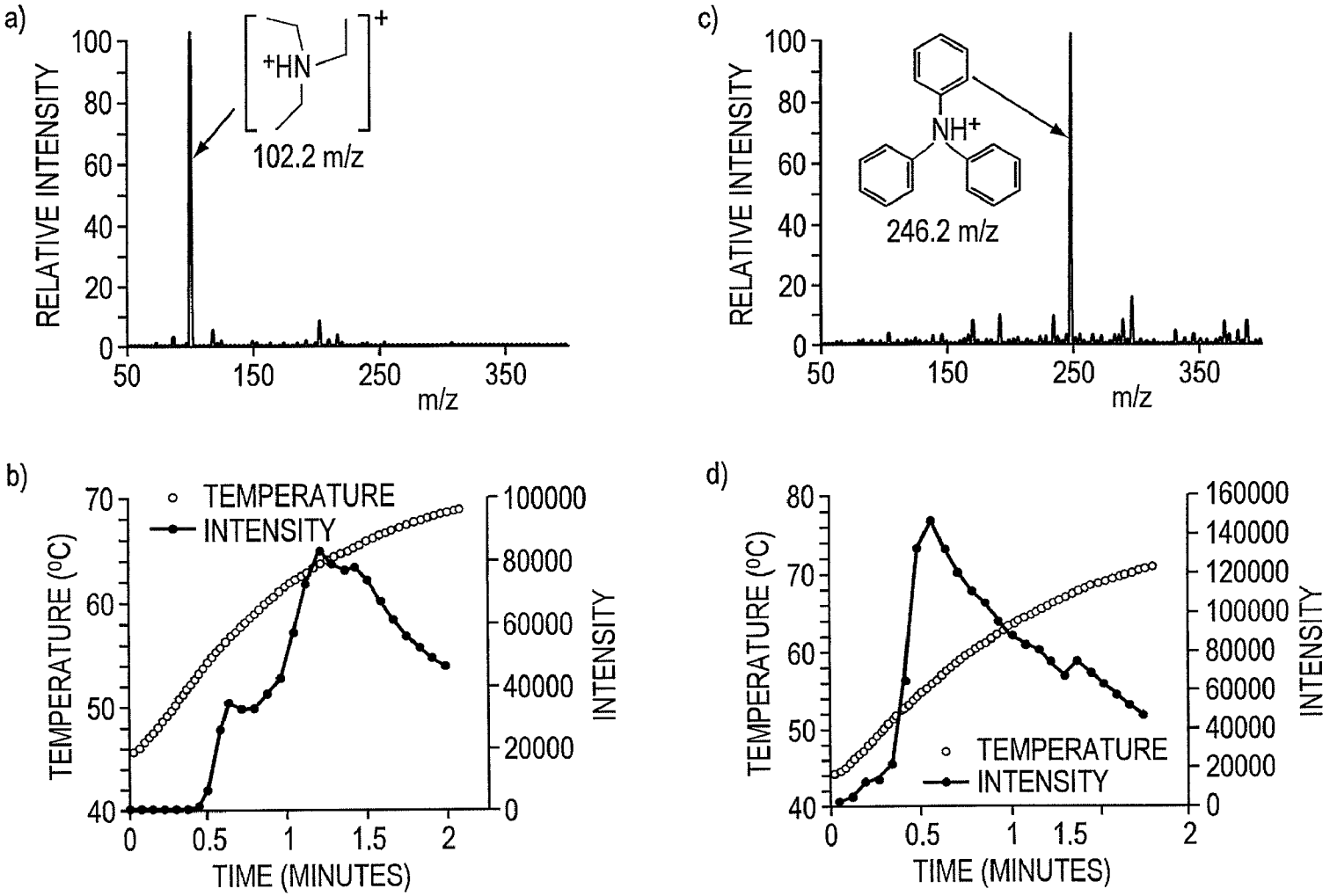
FIG. 7(*a*) is a diagram showing a positive ion mass spectrum of triethylamine, in which the protonated amine is observed.

FIG. 7(*a*) and FIG. 7(*b*) are the positive ion mass spectrum of triethylamine and the temporal variation of ion abundance as the crystal temperature is increased, respectively. The abundant ion in the mass spectrum is the protonated tertiary amine, at 102.2 m/z. FIG. 7(*c*) and FIG. 7(*d*) show similar data for the positive ion mass spectrum of sublimed triphenylamine. The protonated tertiary amine appears in the mass spectrum at 246.2 m/z. In these experiments, ion production is again sporadic.

As can be deduced from the temperature changes vs. time and the superimposed data representing the intensity of ions produced as illustrated in the embodiments described by FIG. 6(*b*), FIG. 6(*d*), FIG. 7(*b*), and FIG. 7(*d*), temperature changes of the order of 10° C. per minute are adequate for producing significant numbers of ions of the samples of interest that have been examined. In the present application, the term "of the order of" is intended to be understood in the conventional mathematical sense, e.g., of the order of 10 could represent a number in the range of more than 5 to approximately 10 and a number in the range of approximately 10 to approximately 90. One notes from analysis of FIG. 6(*b*), FIG. 6(*d*), FIG. 7(*b*), and FIG. 7(*d*) that the rate of production of ions appears to vary with the rate of change of temperature of the pyroelectric substance vs. time, so that an optimal or preferred rate of change of temperature with time may be determined for different samples of interest, and/or different pyroelectric substances. On the other hand, significant numbers of ions (e.g., numbers suitable for detection in a mass spectrometer) are produced over various ranges of rates of change of temperature with time for some samples of interest, so it may not be necessary to maintain an optimal or preferred rate of change of temperature with time in order to detect the presence of some materials of interest. In some instances, merely determining the presence of a material of interest may be adequate, even without making a quantitative determination. If there is a concern that a material of interest will evade detection because a pyroelectric ion source is not operating at the correct rate of change of temperature with time to suitably ionize that material of interest, one could provide a plurality of pyroelectric ion sources in parallel, each pyroelectric ion source operating at a selected rate of change of temperature with time that is different from the other rates of change of temperature with time of the other pyroelectric ion sources, and all exposed to the same ambient input stream, so that there will be an increased likelihood that at least one of the pyroelectric ion sources will produce the requisite ionic species if the material of interest is present in the ambient input stream. It is expected that in some embodiments, one can provide one or more focusing assemblies (such as pairs of electrodes or magnets) to guide the ions produced along a desired path by applying electromagnetic fields and forces, for example to assist the entry of the ions produced into a detector such as a mass spectrometer. Suitable controls for pluralities of pyroelectric ion sources or for focusing assemblies can be provided by dedicated circuitry or by using control systems based on general purpose programmable computers.

Although processes in which ions are formed on the highly charged crystal surface may contribute to the observed signal, ion formation appears to result mainly from electrical discharge occurring at the faces of the crystal. Large electrical potentials build up on the surfaces of the crystal as the temperature is cycled. The change in potential on the face of the crystal in response to a change in temperature ΔT is given by Eq. 1.

$$V = \frac{d_{cr}\varphi\Delta T}{\varepsilon_{cr}} \quad \text{Eq. 1}$$

In Eq. 1 $\phi$ is the pyroelectric coefficient, $d_{cr}$ is the thickness of the crystal, and $\in_{cr}$ is the dielectric constant of the crystal along the z axis ($\in_{cr}$=46 $\in_0$ for $LiTaO_3$, $\in_{cr}$=30 $\in_0$ for $LiNbO_3$). For $LiNbO_3$, $\phi$=70 μC/($m^2$K) and for $LiTaO_3$, $\phi$=190 μC/($m^2$K). For a lithium tantalate crystal with thickness $d_{cr}$=5 mm subjected to a temperature change of 30 K, the potential of the crystal face could reach $7.0\times10^4$ V if no discharging occurred. The crystal face potentials can thus increase beyond the point of dielectric breakdown in air, causing a discharge to occur. Some discharges can be observed with the naked eye in a perfectly dark room; they can also be heard in a quiet room. Although the faces are discharged after a spark, continued temperature change begins the charge buildup process anew, leading to additional discharge. A discharge would produce both positive and negative ions simultaneously, yet only one ion polarity is seen at a time. The polarity of ions seen in the mass spectrometer can be attributed to the sign of the charge on the crystal face facing the atmospheric pressure inlet at a particular moment. For example, a negatively charged crystal face will scavenge cations so that they are not detected by the mass spectrometer, while directing anions towards the capillary inlet.

Figure 8:
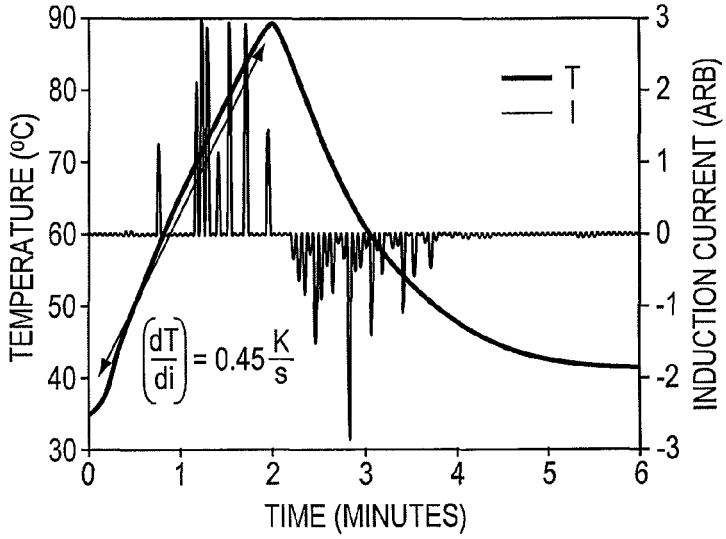
FIG. 8 is a diagram showing the discharges observed by an inductive pickup as the temperature of a pyroelectric crystal changes.
Figure 9:
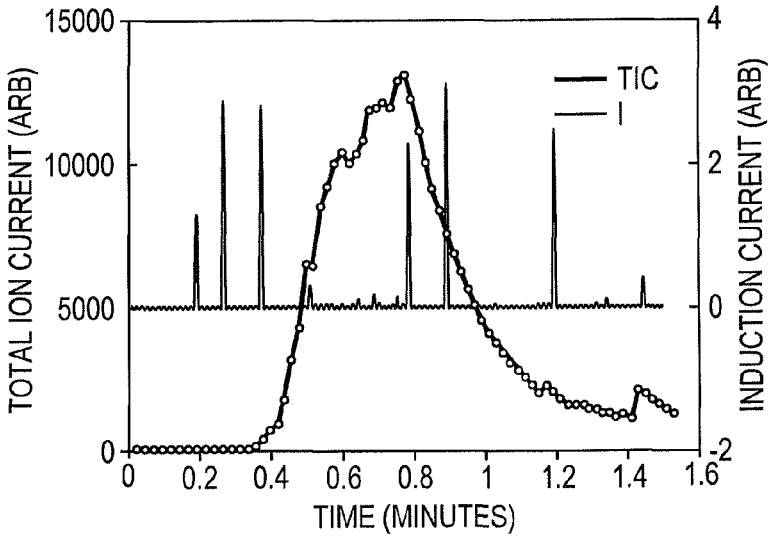
FIG. 9 is a diagram that illustrates that most ions are produced during periods of apparent electrical quiescence.

Ions are produced during times of electrical activity on the surface of the crystal. There are two classes of activity. One class involves spark discharges. The other type of electrical activity is a low current level electrical discharge, occurring at high frequency relative to the spark discharges. The ions are produced mostly during the periods when the low-current, high-frequency discharges occur, rather than in association with the presence of the larger spark discharges. Under similar experimental or operating conditions, the ions detected are the same as those obtained in a stand-alone atmospheric pressure chemical ionization (APCI) experiment, comprising a corona discharge in air. It is therefore expected that any experiment or procedure possible with a corona discharge source should be replicable using the pyroelectric ion source. Some of these features are illustrated in FIG. 8 and FIG. 9. FIG. 8 is a diagram showing the discharges observed by an inductive pickup as the temperature of a pyroelectric crystal changes. FIG. 9 is a diagram that illustrates that most ions are produced during periods of apparent electrical quiescence.

Figure 10:
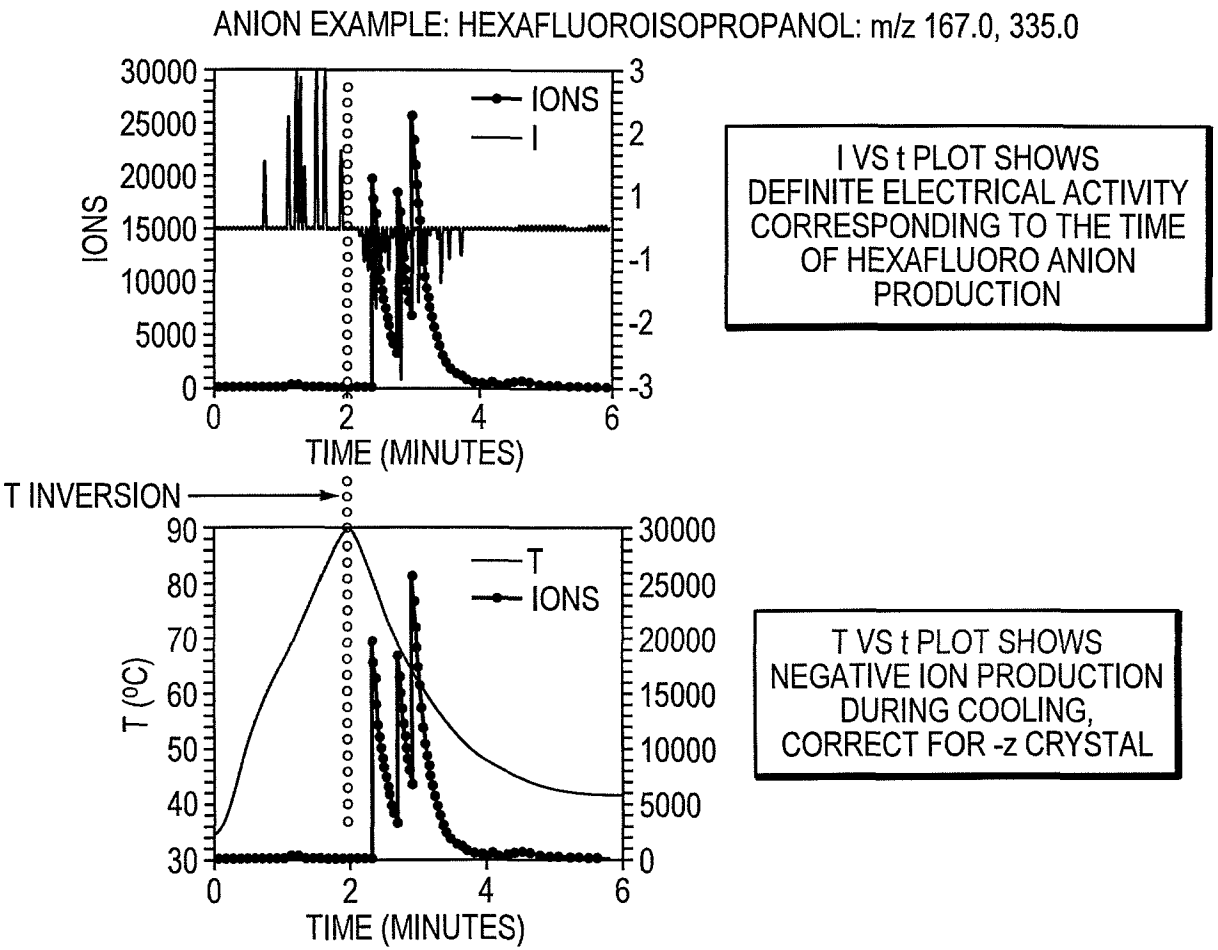
FIG. 10 is a diagram that illustrates some of the features of operation of a pyroelectric ion source of the invention when hexafluoroisopropanol is used as a sample of interest.

In FIG. 10, hexafluoroisopropanol is used as a sample of interest. Anions are produced using this material at the −z-face of the pyroelectric material under cooling conditions. Turning to the upper pane of FIG. 10, there is shown a plot of the relation of ion production (dotted line in the time period from slightly more than 2 to about 4 minutes) vs. time running from zero to approximately 6 minutes as the horizontal axis, and also showing the intermitted electrical activity that is observed during the same time period. In the upper pane of FIG. 10, ion count is indicated on the left vertical axis, and discharge current (in arbitrary units) is indicated on the right vertical axis.

In the lower pane of FIG. 10, there is shown a plot of the relation of ion production (dotted line in the time period from slightly more than 2 to about 4 minutes) vs. time running from zero to approximately 6 minutes as the horizontal axis, and showing the change in temperature (solid curve) which increases from time=0 to approximately time=2 minutes, and then decreases until approximately time=6 minutes. As is clearly observed, ions are generated only during the time period when the temperature is decreasing. A heavy dotted line indicated by the legend "T inversion" appears at substantially the time of 2 minutes into the procedure, passes through the temperature curve at substantially its maximum value (approximately 90° C.) and illustrates that the production of anions occurs only during the interval when the temperature of the pyroelectric crystal is being reduced. In the lower pane of FIG. 10, temperature is indicated on the left vertical axis, and ion count is indicated on the right vertical axis.

Figure 11:
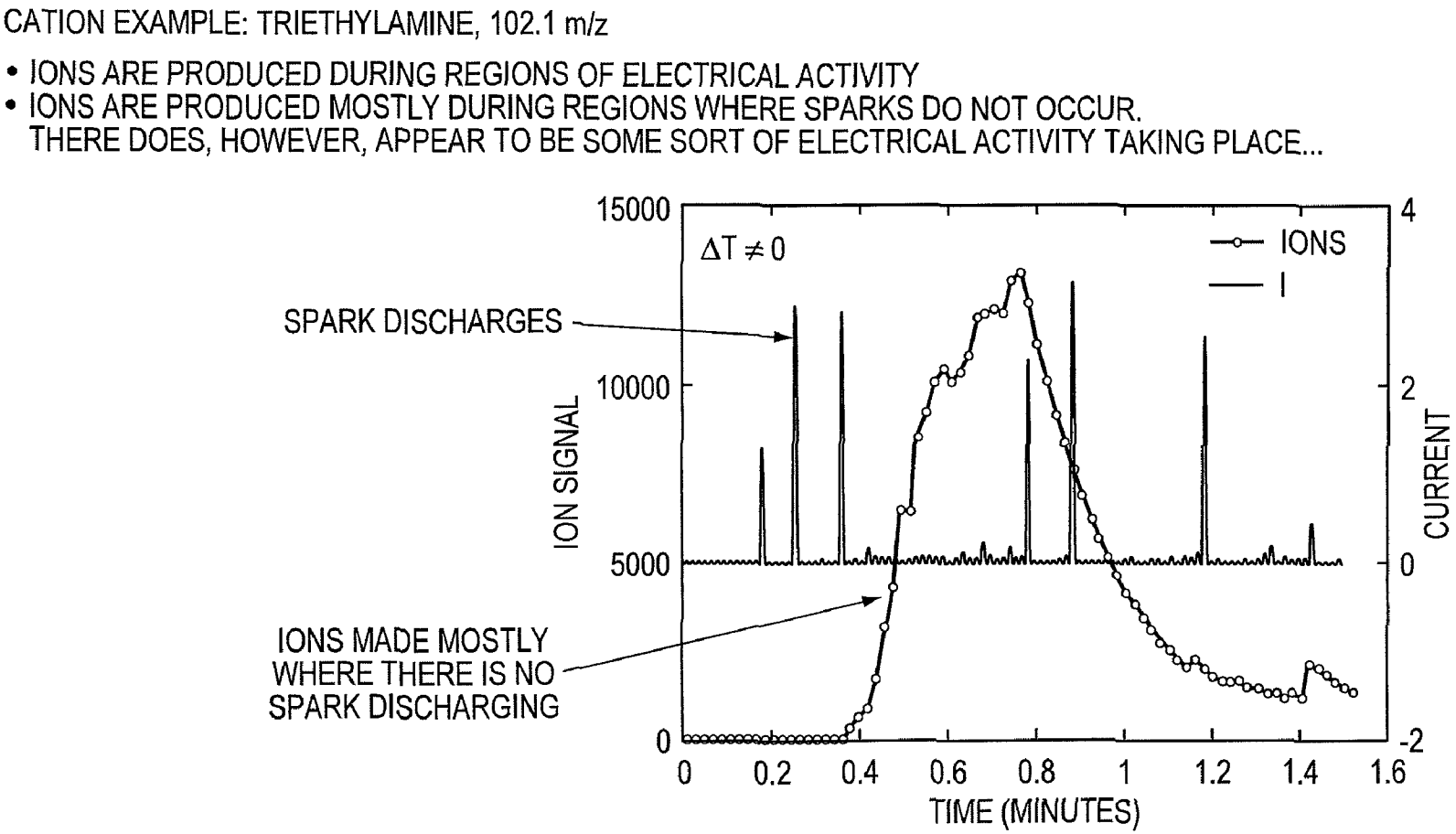
FIG. 11 is a diagram that illustrates some of the features of operation of a pyroelectric ion source of the invention when triethylamine is used as a sample of interest.

In FIG. 11, triethylamine is used as a sample of interest. Cations are produced using this material at the −z-face of the pyroelectric material under non-stationary thermal conditions. In FIG. 11, there is shown a plot of the relation of ion production vs. current, as a function of time over approximately a 1.6 minute interval. In FIG. 11, ion count is indicated on the left vertical axis, and discharge current (in arbitrary units) is indicated on the right vertical axis. From the relation between ion signal and the spark discharges, it appears that ions are generated preferentially when there is little or no spark discharge occurring.

Figure 12:
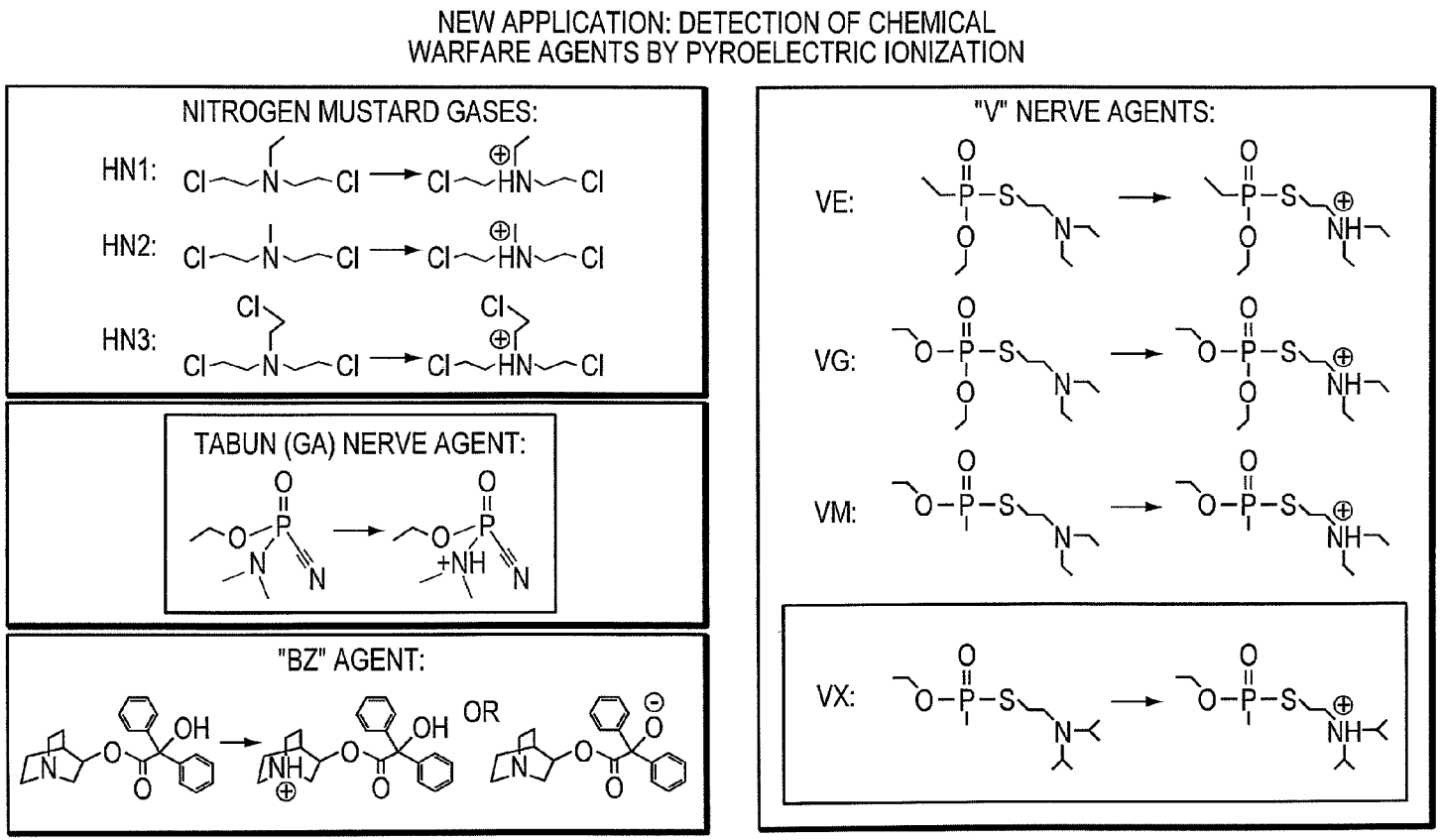
FIG. 12 is a diagram that illustrates the relative structures and ionization products for several chemical warfare agents.

FIG. 12 is a diagram that illustrates the relative structures and ionization products for several chemical species of interest including the nitrogen mustard gases HN1, HN2 and HN3, the nerve agent Tabun (GA), the agent "BZ," and various "V" nerve agents, including VE, VG, VM, and VX. Tabun and VX are well-known chemical warfare agents. From the perspective of protecting a human population or a population of other living beings, there is a strong need to be able to detect the presence of such materials in ambient air.

Figure 13:
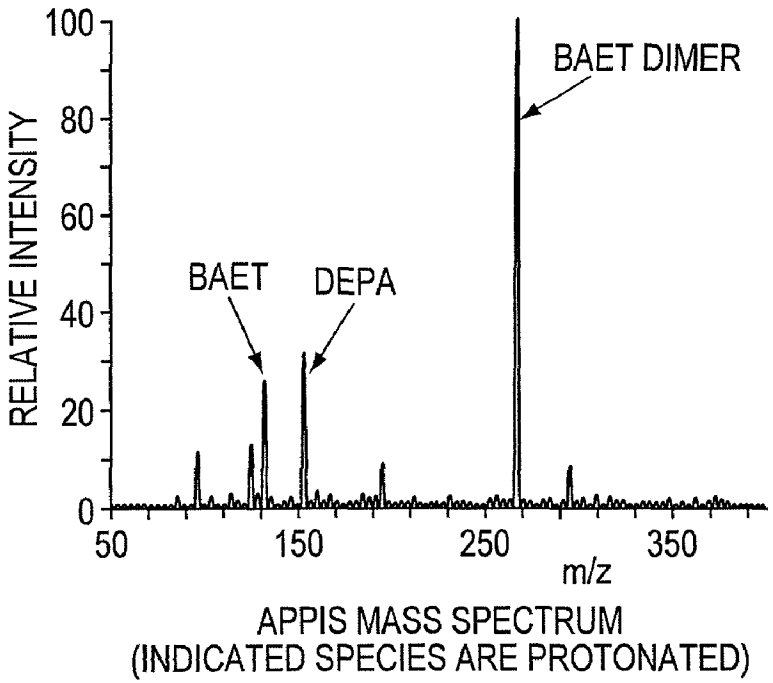
FIG. 13 is a diagram showing the structure of compounds which simulate the reactivity of two classes of chemical nerve agents and showing a mass spectrum obtained of a mixture of two such compounds.
Figure 13:
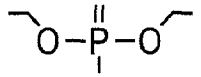
Figure 13:
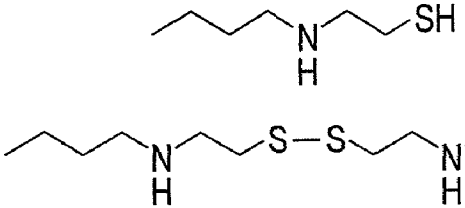

In another embodiment, the ion source was used to detect compounds which simulate the structure and the reactivity of chemical nerve agents. It is hypothesized that since the ion source shows protonation of amine species under typical experimental conditions, it is to be expected that it would protonate any chemical nerve agent containing a secondary or tertiary amine. The compounds depicted on the left side of FIG. 13 are compounds that fall into this category, having an amine group which can be protonated. On the right side of FIG. 13 there is shown a mass spectrum obtained of a mixture of two compounds which simulate the reactivity of two classes of chemical nerve agents. DEPA simulates Tabun, while BAET simulates VX. These compounds, which are also called nerve gases, are expected to be encountered in the vapor phase, making the pyroelectric ion source suitable for the direct detection of these chemical weapons in the environment. It is expected that the pyroelectric ion source of the invention may be used to detect various substances that could be used as chemical and biological weapons (CBW).

The source is extremely durable. No particular care was taken to protect the surface of the crystal from scratches or contamination while being used. It was touched frequently by bare fingers, leaving visible fingerprints on the crystal surface, with no degradation in performance. As a more extreme test of durability, a 1 to 2 mm thick layer of Dow-Corning silicone vacuum grease was applied to all exposed surfaces of the crystal. The mass spectra collected with this coating were no different than those obtained with a clean crystal.

It is expected that this robust source will prove particularly useful in applications where unattended operation in harsh environments, long service lifetimes, and durability are desirable characteristics. Such applications might include instrumentation for detection of organic molecules in space environments, the detection of CBW agents in battlefield situations, and the monitoring of volatiles from industrial accidents or chemical spills by first responders or hazardous materials cleanup teams.

General Purpose Programmable Computers

General purpose programmable computers useful for controlling instrumentation, recording signals and analyzing signals or data according to the present description can be any of a personal computer (PC), a microprocessor based computer, a portable computer, or other type of processing device. The general purpose programmable computer typically comprises a central processing unit, a storage or memory unit that can record and read information and programs using machine-readable storage media, a communication terminal such as a wired communication device or a wireless communication device, an output device such as a display terminal, and an input device such as a keyboard. The display terminal can be a touch screen display, in which case it can function as both a display device and an input device. Different and/or additional input devices can be present such as a pointing device, such as a mouse or a joystick, and different or additional output devices can be present such as an enunciator, for example a speaker, a second display, or a printer. The computer can run any one of a variety of operating systems, such as for example, any one of several versions of Windows, or of MacOS, or of Unix, or of Linux.

In operation, a general purpose programmable computer is programmed with instructions in the form of software or firmware. The instructions control the operation of the general purpose programmable computer. The general purpose programmable computer can perform a variety of manipulations of data, such as mathematical operations (e.g., calculations), logical operations (e.g., comparisons, or logical deductions following defined rules), and processing of textual or graphical data (e.g., word processing, or image processing). Data can be provided to the general purpose programmable computer as recorded data or as real-time data. The result of any computation or processing operation is recorded in a machine-readable medium or memory for immediate use or for future use. For example, in micro-processor based analysis modules, data can be recorded in a register in a microprocessor, in a cache memory in the microprocessor, in local memory such as semiconductor memory (e.g., SRAM, DRAM, ROM, EPROM), magnetic memory (e.g., floppy disc or hard disc) and/or optical memory (e.g., CD-ROM, DVD, HD-DVD), or in a remote memory such as a central database. Future use of data recorded in a machine-readable medium can include displaying, printing, or otherwise communicating the data to a user, using the data in a further calculation or manipulation, or communicating the data to another computer or computer-based device.

Machine-readable storage media that can be used in the invention include electronic, magnetic and/or optical storage media, such as magnetic floppy disks and hard disks, a DVD drive, a CD drive that in some embodiments can employ DVD disks, any of CD-ROM disks (i.e., read-only optical storage disks), CD-R disks (i.e., write-once, read-many optical storage disks), and CD-RW disks (i.e., rewriteable optical storage disks), and electronic storage media, such as RAM, ROM, EPROM, Compact Flash cards, PCMCIA cards, or alternatively SD or SDIO memory, and the electronic components (e.g., floppy disk drive, DVD drive, CD/CD-R/CD-RW drive, or Compact Flash/PCMCIA/SD adapter) that accommodate and read from and/or write to the storage media. As is known to those of skill in the machine-readable storage media arts, new media and formats for data storage are continually being devised, and any convenient, commercially available storage medium and corresponding read/write device that may become available in the future is likely to be appropriate for use, especially if it provides any of a greater storage capacity, a higher access speed, a smaller size, and a lower cost per bit of stored information. Well known older machine-readable media are also available for use under certain conditions, such as punched paper tape or cards, magnetic recording on tape or wire, optical or magnetic reading of printed characters (e.g., OCR and magnetically encoded symbols) and machine-readable symbols such as one and two dimensional bar codes.

Many functions of electrical and electronic apparatus can be implemented in hardware (for example, hard-wired logic), in software (for example, logic encoded in a program operating on a general purpose processor), and in firmware (for example, logic encoded in a non-volatile memory that is invoked for operation on a processor as required). The present invention contemplates the substitution of one implementation of hardware, firmware and software for another implementation of the equivalent functionality using a different one of hardware, firmware and software. To the extent that an implementation can be represented mathematically by a transfer function, that is, a specified response is generated at an output terminal for a specific excitation applied to an input terminal of a "black box" exhibiting the transfer function, any implementation of the transfer function, including any combination of hardware, firmware and software implementations of portions or segments of the transfer function, is contemplated herein.

Theoretical Discussion

Although the theoretical description given herein is thought to be correct, the operation of the devices described and claimed herein does not depend upon the accuracy or validity of the theoretical description. That is, later theoretical developments that may explain the observed results on a basis different from the theory presented herein will not detract from the inventions described herein.

While the present invention has been particularly shown and described with reference to the structure and methods disclosed herein and as illustrated in the drawings, it is not confined to the details set forth and this invention is intended to cover any modifications and changes as may come within the scope and spirit of the following claims.

What is claimed is:

1. An ion source for mass spectrometry configured to be operable at ambient pressure, comprising:

a pyroelectric substance having a first face and a second face, at least said first face disposed substantially normal to a polarization axis of said substance;

a selected one of a heater and a cooler disposed adjacent said second face of said pyroelectric substance;

a power supply in communication with said selected one of a heater and a cooler, said power supply configured to provide energy sufficient to change a temperature of said first face of said pyroelectric substance at a rate of the order of 10° C. per minute;

a vapor entry port for a sample of interest, said vapor entry port configured to operate at ambient pressure, said vapor entry port configured to allow said entering vapor to interact with said first face of said pyroelectric substance;

an exit port configured to provide a stream of ionized species at ambient pressure;

wherein said ion source is configured to produce a stream of ionized species at ambient pressure in response to a change in temperature of said first face of said pyroelectric substance.

2. The ion source for mass spectrometry configured to be operable at ambient pressure of claim 1, wherein said entering vapor interacts electrically with said first face of said pyroelectric substance.

3. The ion source for mass spectrometry configured to be operable at ambient pressure of claim 2, wherein said polar crystal is a selected one of lithium niobate, lithium tantalate, lead lanthanum zirconate titanate, barium titanate, and tourmaline.

4. The ion source for mass spectrometry configured to be operable at ambient pressure of claim 1, further comprising a vapor containment shroud.

5. The ion source for mass spectrometry configured to be operable at ambient pressure of claim 1, wherein said pyroelectric substance comprises a polar crystal.

6. The ion source for mass spectrometry configured to be operable at ambient pressure of claim 1, wherein said first face and said second face of said pyroelectric substance are each disposed substantially normal to a polarization axis of said substance.

7. The ion source for mass spectrometry configured to be operable at ambient pressure of claim 1, wherein said selected one of a heater and a cooler is a selected one of a resistance heater and a Peltier device.

8. The ion source for mass spectrometry configured to be operable at ambient pressure of claim 1, wherein said power supply is an electrical power supply.

9. The ion source for mass spectrometry configured to be operable at ambient pressure of claim 8, further comprising a measurement and control circuit configured to control a selected one of a temperature change magnitude and a temperature change rate.

10. The ion source for mass spectrometry configured to be operable at ambient pressure of claim 1, wherein said exit port is an atmospheric inlet of a mass spectrometer.

11. The ion source for mass spectrometry configured to be operable at ambient pressure of claim 1, further comprising a temperature measuring device adjacent said pyroelectric substance.

12. The ion source for mass spectrometry configured to be operable at ambient pressure of claim 1, wherein said first face and said second face of said pyroelectric substance are disposed substantially normal to a polarization axis of said pyroelectric substance, and are spaced apart at any distance from one another.

13. A mass spectrometer comprising an atmospheric pressure inlet in fluid communication with said ion source configured to be operable at ambient pressure of claim 1.

14. A method of generating a stream of ions at ambient pressure, comprising the steps of:

providing a pyroelectric substance having a first face and a second face, at least said first face disposed substantially normal to a polarization axis of said substance, providing a selected one of a heater and a cooler disposed adjacent said second face of said pyroelectric substance, providing a power supply in communication with said selected one of a heater and a cooler, said power supply configured to provide energy sufficient to change a temperature of said first face of said pyroelectric substance at a rate of the order of 10° C. per minute, providing a vapor of a sample of interest, said vapor interacting with said first face of said pyroelectric substance, providing an exit port configured to allow the exit of a stream of ionized species at ambient pressure, and changing a temperature of said first face of said pyroelectric substance during a time interval when said vapor of said sample of interest is proximal to said first face of said pyroelectric substance so as to produce ions of said sample of interest, whereby a stream of ions at ambient pressure is provided at said exit port.

15. The method of generating a stream of ions at ambient pressure of claim 14, further comprising the step of:

controlling a selected one of a temperature change magnitude and a temperature change range of said first face of said pyroelectric substance.

16. The method of generating a stream of ions at ambient pressure of claim 14, wherein said stream of ions at ambient pressure comprises a stream of positive ions.

17. The method of generating a stream of ions at ambient pressure of claim 14, wherein said stream of ions at ambient pressure comprises a stream of negative ions.

18. The method of generating a stream of ions at ambient pressure of claim 14, wherein said stream of ions at ambient pressure comprises chemical nerve agent ions.

19. The method of generating a stream of ions at ambient pressure of claim 18, wherein said chemical nerve agent ions include ions derived from the V nerve agent class.

20. The method of generating a stream of ions at ambient pressure of claim 18, wherein said chemical nerve agent ions include ions derived from Tabun.

* * * * *